United States Patent [19]

Harada

[11] Patent Number: 4,613,833

[45] Date of Patent: Sep. 23, 1986

[54] TRANSMISSION CHANNEL COUPLER FOR ANTENNA

[75] Inventor: Takuji Harada, Hiratsuka, Japan

[73] Assignee: Harada Kogyo Kabushiki Kaisha, Tokyo, Japan

[21] Appl. No.: 716,827

[22] Filed: Mar. 27, 1985

[30] Foreign Application Priority Data

Dec. 30, 1984 [JP] Japan ..... 59-280845

[51] Int. Cl.[4] ..... H01P 5/02; H01P 7/00; H01Q 1/27

[52] U.S. Cl. ..... 333/24 R; 333/24 C; 333/219; 333/222; 343/715

[58] Field of Search ..... 333/24 R, 27, 24 C, 333/219, 202–208, 222, 227, 223, 231, 235; 343/712–715, 745, 850, 856, 905, 906, 749, 700 R, 710, 711, 878

[56] References Cited

U.S. PATENT DOCUMENTS 2,829,367 4/1958 Rychlik ..... 343/850
3,939,443 2/1976 Biró et al. ..... 333/207 X
4,238,799 12/1980 Parfitt ..... 343/749 X

*Primary Examiner*—Marvin L. Nussbaum
*Attorney, Agent, or Firm*—Koda and Androlia

[57] ABSTRACT

A transmission channel coupler for an antenna including a first resonator and a second resonator. Each resonator has a helical conductor and an outer conductor which is disposed outside of the helical conductor by sharing the same axis with the helical conductor. One end of the helical conductor is electrically connected to the inner wall of the outer conductor, and the other end of the helical conductor is positioned within the area defined by an end face of the outer conductor. The first and second resonators are coaxially mounted on the either side of a glass such as rear window of a car, window of a building, etc. By means of the structure above, high frequency signals are transmitted through an insulating material, that is, the glass, without damaging it. Also, the coupler can be manufactured small in size and provides excellent frequency characteristics with less transmission loss.

15 Claims, 9 Drawing Figures

TRANSMISSION CHANNEL COUPLER FOR ANTENNA

BACKGROUND OF THE INVENTION

1. Field of the Invention

The present invention relates to a coupler used for transmitting high frequency signals through insulating material.

2. Prior Art

For transmitting high frequency signals through insulating materials, such as glass, etc., it is desirable for the high frequency signals to be transmitted without damaging the insulating materials. For example, when connecting a communication device installed in a car to an antenna mounted outside of the car, it is desirable not to damage the car.

There are two types of known devices which meet such a requirement: a device using a capacitor coupling and a device using loop coils.

The device using the capacitor coupling includes two electrodes with glass interposed in between forming a capacitor composed of the two electrodes and the glass. High frequency signals are transmitted by means of the electrostatic capacity (capacitance) of this capacitor (condenser). However, this device has disadvantages: transmission loss is relatively great and also, the transmitted frequency characteristics are not uniform.

On the other hand, the device using the loop coil is designed to have two loop coils with a piece of glass placed in between so that electromagnetic coupler is effected between those two loop coils. The advantages of this device are that transmission loss is relatively less and frequency characteristics are uniform.

The above-mentioned device using the loop coil, however, has a problem. In order to reduce transmission loss and to make frequency characteristics uniform, the loop coils must be very large in size. Accordingly, for example, when the device is mounted on the window shield of a car, it obscures visibility.

SUMMARY OF THE INVENTION

The object of this invention is, therefore, to overcome the drawbacks and disadvantages in existing devices.

Another object of this invention is to provide a transmission channel coupler for an antenna for transmitting high frequency signals through an insulating material without causing damage to the insulator with excellent frequency characteristics and less transmission loss.

The above and other objects of this invention are achieved by the unique structure for a transmission channel coupler for an antenna including a helical conductor and an outer conductor which is almost coaxial with the helical conductor. One end of the helical conductor is electrically connected to the inner wall of the outer conductor and the other end of the helical conductor is fixed to a spot within the area formed by the end face of the outer conductor, forming a resonator. Two resonators, formed as described above, are disposed with glass interposed in between, and the resonators are fixed coaxially to each other.

DETAILED DESCRIPTION OF THE INVENTION

Figure 1:
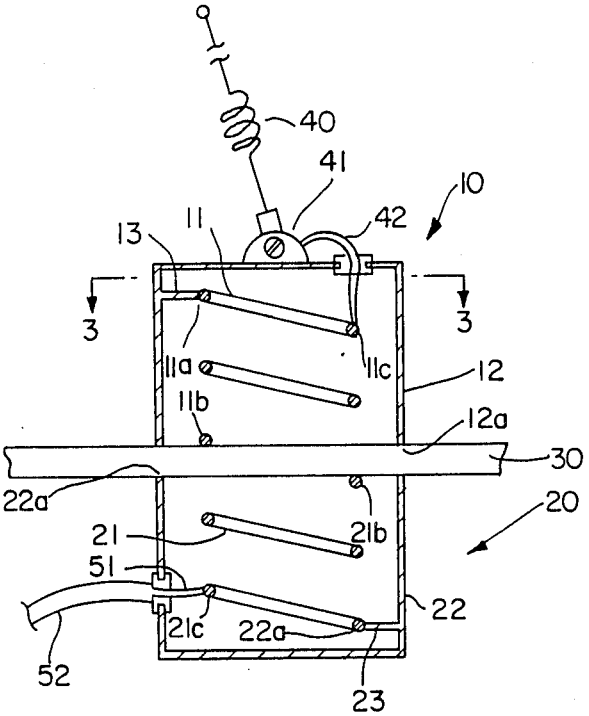
FIG. 1 is a longitudinal sectional view showing an embodiment, coupler, according to the present invention.
Figure 2:
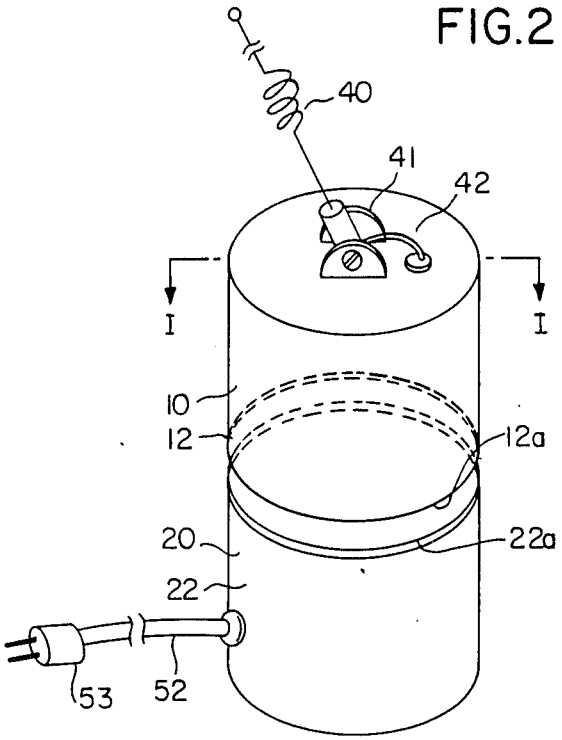
FIG. 2 is a perspective view thereof.
Figure 3:
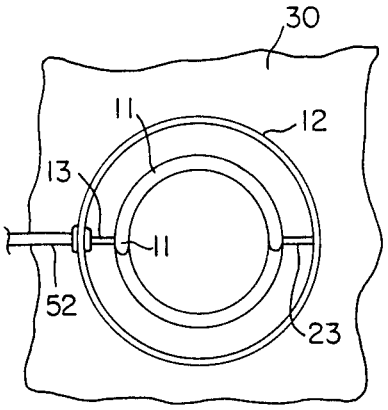
FIG. 3 is a cross section taken along the line 3—3 in FIG. 1.

FIG. 2 is a perspective view showing an embodiment of this invention. FIG. 1 is a longitudinal cross section taken along the line I—I in FIG. 2. FIG. 3 is a cross-section taken along the line 3—3 in FIG. 1.

In this embodiment, first resonator 10 and second resonator 20 are disposed so as to face each other with glass 30 interposed between them.

The first resonator 10 includes helical conductor 11, outer conductor 12, and conducting wire 13.

The helical conductor 11 is a helical form conductor with one end 11*a* grounded to the outer conductor 12 and the other end 11*b* contacting the glass 30. The tapping position 11*c* of the conductor 11 is connected to an antenna element 40. The end 11*b* of the conductor 11 and the outer conductor 12 are in an opened state, but they may be held by separating with capacitance less than several picofarads.

The outer conductor 12 is disposed outside of the helical conductor 11 so as to be nearly coaxially with the helical conductor 11. The shape of this outer conductor 12 may be a cylindrical column, angular column, etc.

The conducting wire 13 is a single member and has two functions. The conducting wire 13 functions as a connecting means to eletrically connect end 11*a* of the helical conductor 11 to the inner wall of the outer conductor 12 and also functions as a conductor fixing means to fasten end 11*b* of the helical conductor 11 to a location within the area surrounded by the end face 12*a* of the outer conductor 12.

The antenna 40 is connected to tapping position 11*c* of the helical conductor 11 through antenna seat 41 and antenna leader line 42. The antenna seat 41 is insulated from the outer conductor 12.

The structure of the second resonator 20 is the same as the first resonator 10. The resonator 20 includes helical conductor 21, outer conductor 22, and conducting wire 23. The helical conductor 21, the outer conductor 22, and the conducting wire 23 are identical to the helical conductor 11, the outer conductor 12, and the conducting wire 13, respectively. Also, the ends 11*a* and 11*b* of the conductor 11 and the end faces 12*a* are identical to ends 21*a* and 21*b* of the conductor 21 and end face 22*a* of the conductor 22, respectively. Furthermore, the functions of the above-mentioned respective members forming the second resonator 20 are the same as those of the respective members of the first resonator 10. The tapping positions 11*c* and 21*c* can be adjusted in accordance with outside impedance.

The first resonator 10 and the second resonator 20 are coaxially fixed on glass 30 which is interposed between the two resonators. Thus, the end face 12*a* of the outer conductor 12 is fastened to the glass 30, while the end face 22*a* of the outer conductor 22 is also fastened to the glass 30. Also, the helical conductor 11 is coaxial with the helical conductor 21, while the outer conductor 12 shares the same axis with the outer conductor 22. Any fixing method can be employed for fixing the resonators.

It is necessary for the inside diameter of each of the outer conductors 12 and 22 to be almost equal to each other, but the thickness of the outer conductor 12 and that of the outer conductor 22 may be different.

A leaderline 51 connects the tapping position 21*c* of the helical conductor 21 to a connecting line 52 connected to a communication device. To the end of the connecting line 52, a connector 53 is connected.

In addition, the resonance frequency of the first resonator 10 is set approximately equal to the resonance frequency of the second resonator 20. That is, the discrepancy between both the resonance frequencies is within several percent. However, with increase in band width, the discrepancy may be greater.

In FIG. 2, the glass 30 and the helical conductor 21 are omitted.

Next, a description of the operation of the embodiment mentioned above will be given.

Figure 4:
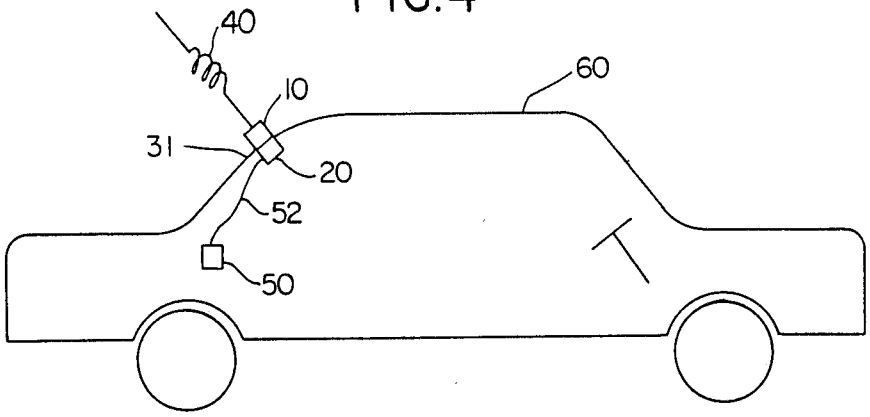
FIG. 4 is an illustration showing the coupler mounted on a car.

FIG. 4 shows an example in which the transmission channel coupler of the present invention is mounted on an automobile.

First, the first resonator 10 and the second resonator 20 are fixed to face each other such that a rear window 31 of a car 60 is sandwiched between the resonators 10 and 20. In this case, the first resonator 10 and the second resonator 20 are disposed to be coaxial with each other. Then, the antenna element 40 is connected to the first resonator 10. On the other hand, a communication device 50, such as a radio, etc., is installed inside the car 60, and by way of the connecting line 52, the communication device 50 is connected to the second resonator 20.

With this arrangement, the magnetic field leaks between the first resonator 10 and the second resonator 20, and the necessary Q-factor and coupling coefficient K are obtained. Thus, transmission loss is reduced.

More specifically, first, through the coaxial allocation of the helical conductor 11 (or 21) and the outer conductor 12 (or 22), the Q-factor at no load (hereunder called "unloaded Q", and represented by "$Q_O$") increases in value. The value of $Q_O$ becomes several times higher than that obtained by an ordinary loop coil. That is, while $Q_O$ of an ordinary loop coil is about 200, the $Q_O$ of the first resonator 10 and the second resonator 20 each become above 1,000. On the other hand, the Q factor on load (hereunder, called "loaded Q", and indicated by "$Q_L$") is determined automatically when the frequency band is set, and the value of the $Q_L$ is equal for the loop coil and for the embodiment of this invention. Accordingly, the ratio $Q_O/Q_L$ for the foregoing embodiment is several times larger than when using an ordinary loop coil. As the ratio $Q_O/Q_L$ increases as mentioned above, transmission efficiency is improved in the embodiment of this invention when compared with a loop coil.

Usually, the helical resonator is regarded as a variation of a cavity resonator. Consequently, the coupling coefficient K does not increase in value merely by bringing such resonators close in position. However, in the embodiment mentioned above, the end 11*b* or 21*b* of the helical conductor is fixed to a position within the area formed by the end face 12*a* or 22*a* of the outer conductor, and this area is securely placed on the glass 30 with no space. As a result, the coupling coefficient K for coupling the first resonator 10 and the second resonator 20 becomes larger in value.

For the case where the antenna element 40 and the communication device 50 are connected to each other, the value of $Q_L$ of the first resonator 10 and the value $Q_L$ of the second resonator 20 are nearly equal.

The shapes of the first resonator 10 and the second resonator 20 are determined in a manner that the relationship of $K \cdot Q_L = 1$ can be established approximately when the coupling coefficient for the first resonator and the second resonator is set to be K. The reason for setting the relationship of $K \cdot Q_L = 1$ is to widen the frequency band.

Figure 7:
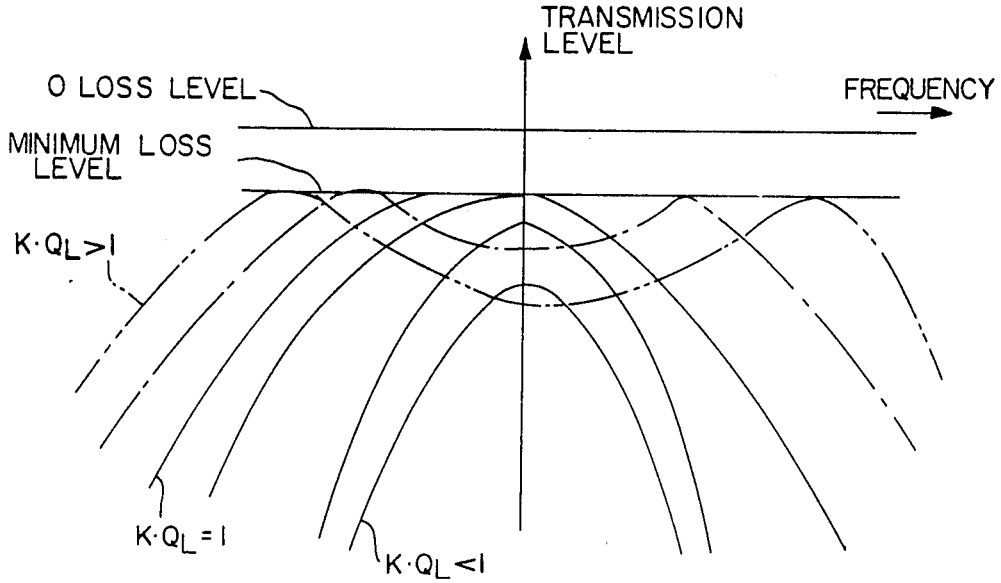
FIG. 7 is a chart of the loss levels depending on $K \cdot Q_L$.

FIG. 7 is a chart showing how the loss level varies in relation to frequency when the value $K \cdot Q_L$ is varied.

Within the range $K \cdot Q_L < 1$ (indicated by fine solid lines), the loss level exceeds the minimum loss level, and as the value of $K \cdot Q_L$ decreases, the loss level gradually further exceeds the minimum loss level. On the other hand, in the range $K \cdot Q_L > 1$ (indicated by a dotted line and a double-dotted line), there are two ranges for the minimum loss level, and in the frequency band between those two minimum loss ranges, the loss is increased. In this case, the loss is increased gradually with increase in the value of $K \cdot Q_L$ as shown with the dotted line and the double-dotted line; that is, the value of $K \cdot Q_L$ is greater in the state shown by the double-dotted line than the state shown by the dotted line. Compared with the above, in the case of $K \cdot Q_L = 1$ (indicated by a fat solid line), the band width at the minimum loss level is wider.

Figure 6:
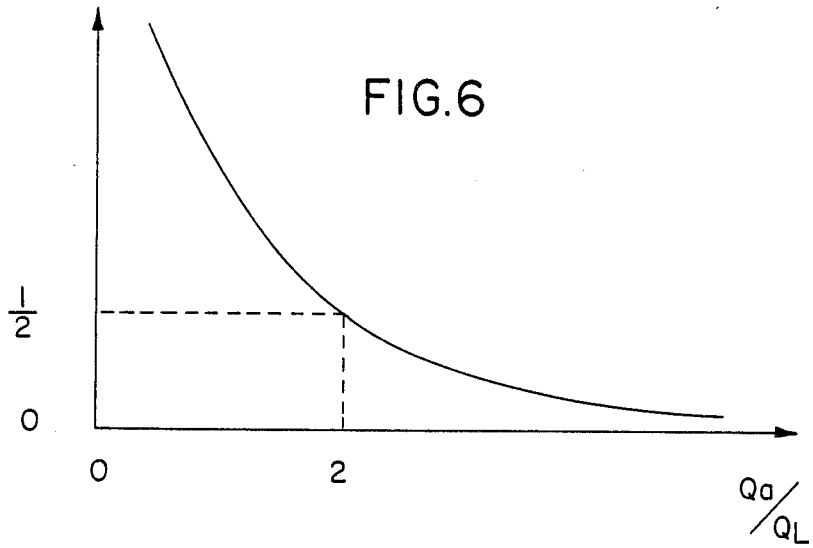
FIG. 6 is a chart of the loss level in relation to $Q_O/Q_L$.

In the above-mentioned embodiment, $K \cdot Q_L = 1$ can be materialized, and in this case, as $Q_L$ is not so much greater than $Q_O$ in value, transmission loss can be reduced as described above. Contrary to this, in the conventional case using the loop coil, it is difficult to establish the relationship of $K \cdot Q_L = 1$. Although $K \cdot Q_L = 1$ can be materialized forcibly by adjusting the tapping position, in such a case, $Q_L$ increases in value against $Q_O$, decreasing the value $Q_O/Q_L$. As a result, as is apparent from FIG. 6, transmission loss increases.

Figure 5:
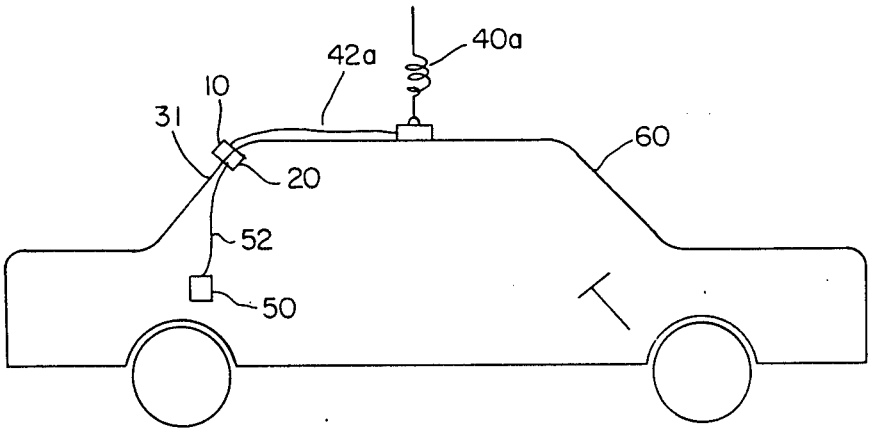
FIG. 5 is an illustration of another example of the coupler mounted on a car.

Also, as shown in FIG. 5, an antenna element 40*a* may be mounted on the roof of the car 60 by using a long antenna connecting line 42*a*.

It is preferable to set the ratio of the inside diameter of the outer conductors 12 and 22 of the first or second resonator to the outside diameter of the helical conductors 11 and 21 of the first or second resonator to be 1.1–2.0. It is desirable that the foregoing ratio is 1.2–2.0 when the outer conductors 12 and 22 are cylindrical in shape, while it is preferable that the above-mentioned ratio is 1.1–1.8 when the outer conductors 12 and 22 are in an angular column shape.

The coiling direction of the helical conductor 11 of the first resonator 10 is arranged to be identical with the spiraling direction of the helical conductor 21 of the second resonator 20. This is because when the coiling directions are the same, the electrostatic effect increases the value of the actual cooling coefficient between the first resonator 10 and the second resonator 20. Needless to say, however, the coiling directions of the helical conductor 11 and the helical conductor 21 may be opposite to each other.

In addition, instead of the helical conductors 11 and 21 which make the connection at the tapping positions 11*c* and 21*c*, the so-called close coiling bifilar coil formed by closely winding the mutually separate helical conductor for input/output and a helical conductor for tuning may be used.

Furthermore, between the glass 30 and the first resonator 10 and the second resonator 20, an adhesive tape, a protecting insulator, etc. may be interposed without letting the glass 30 and the first resonator 10 or the second resonator 20 be positioned in tight contact.

Figure 8:
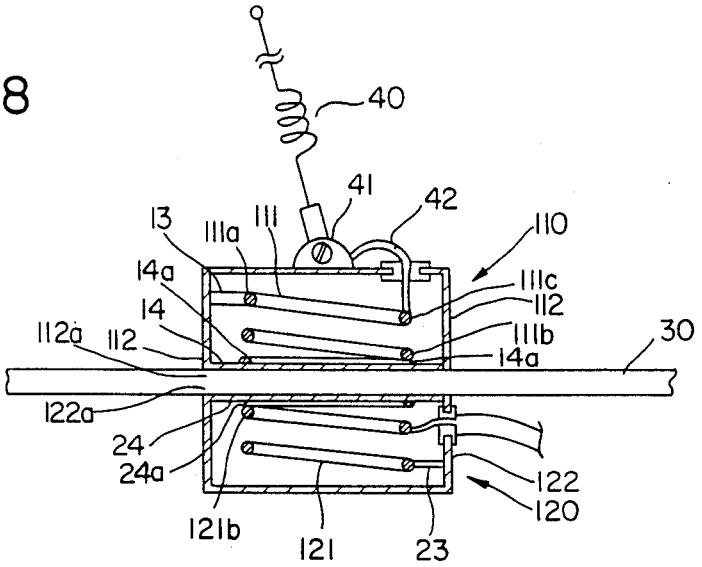
FIG. 8 is a longitudinal sectional view taken along the line 8—8 of FIG. 9.
Figure 9:
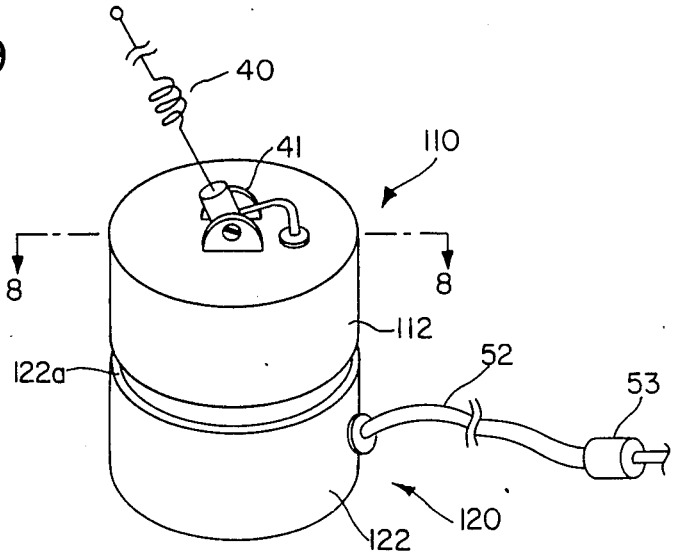
FIG. 9 is a perspective view of another embodiment according to this invention.

FIG. 9 is a perspective view showing another embodiment in accordance with this invention. FIG. 8 is a longitudinal sectional view taken along the line VIII—VIII in FIG. 9. The members are the same as those shown in FIG. 1 through FIG. 3 and are indicated by the same reference numerals with their explanations omitted.

This embodiment is different from the embodiment shown in FIG. 1 through FIG. 3 in that a printed circuit board 14 having a circular pattern 14*a* is installed on end face 112*a* of outer conductor 112, with the other end 111*b* of helical conductor 111 connected to the pattern 14*a* of the printed circuit board 14. The description given above is of a first resonator 110, but the same description applies to the second resonator 120.

Specifically, a printed circuit board 24 having a circular pattern 24*a* is installed on an end face 122*a* of the outer conductor 122, and the other end of the helical conductor 121 is connected to the pattern 24*a*.

The operations of the embodiment shown in FIG. 8 and FIG. 9 are basically the same as those shown in the embodiment of FIG. 1 through FIG. 3; however, there are some differences in terms of the following points:

It is easier to fix the printed circuit board 14 than to fix the helical conductor; therefore, the helical conductors 111 and 121 can be more easily fixed in the latter embodiment than in the former embodiment. Besides, since it is easy to shape the patterns 14*a* and 24*a* exactly into preset forms, the helical form conductor located near the glass 30 can be shaped more accurately with less deviation resulting. Furthermore, since the helical form conductors located near the end faces 112*a* and 122*a* of the outer conductors 112 and 122 cross the axis orthogonally, the coupling coefficient K for mutual coupling of the resonators becomes higher in value. As a result, the overall shape of the transmission channel coupler for an antenna can be further reduced in size.

In the embodiment described above, the glass 30 is window glass of a car, but it may be another type of glass. For example, it may be window glass of a building. Also, in place of glass, other insulating material may be used.

As should be apparent from the description given above, the transmission channel coupler for an antenna provided by the present invention is used for transmitting high frequency signals through insulating material without damaging the insulating material and shows highly desirable transmission frequency characteristics with less transmission loss. Furthermore, according to this invention, a small size transmission channel coupler can be manufactured.

I claim:

1. A transmission channel coupler for a VHF or UHF antenna for coupling electromagnetic energy through an insulated material comprising:

an ungrounded outer conductor having first and second ends; and a helical conductor having first and second ends provided within and substantially coaxial with said outer conductor, said first and of said helical conductor being electrically connected to a point on an inner wall of said outer conductor which is adjacent said first end of said outer conductor, said helical conductor and said outer conductor being arranged and configured such that a ratio of an inside diameter of the outer conductor to an outside diameter of said helical conductor 1.1–2.0.

2. A transmission channel coupler for an antenna according to claim 1, wherein the outer conductor is a cylindrical column in shape.

3. A transmission channel coupler for an antenna according to claim 1, wherein the second end of the helical conductor and the outer conductor are ungrounded and separated from each other.

4. A transmission channel coupler for an antenna according to claim 1, wherein the second end of the helical conductor and the outer conductor are held in a state of being separated with a capacitance less than several picofarads.

5. A transmission channel coupler for a VHF or UHF antenna coupling electromagnetic energy through an insulated material comprising:

a first resonator comprising:

an ungrounded outer conductor having first and second ends;

a helical conductor having first and second ends provided within and substantially coaxial with the outer conductor, said first end of said helical conductor being electrically connected to a point on an inner wall of said outer conductor which is adjacent said first end of said outer conductor, said helical conductor and said outer conductor being arranged and configured such that a ratio of an inside diameter of the outer conductor to an outside diameter of said helical conductor is 1.1–2.0; and a conductor fixing means for fixing the second end of said helical conductor within an area formed by an end face of the second end of the outer conductor;

a second resonator having the same structure as that of the first resonator; and a resonator fixing means for fixing an end face of the first resonator to an insulating material, fixing the end face of the second resonator to the insulating material and for fixing the first resonator and the second resonator along the same axis.

6. A transmission channel coupler for an antenna according to claim 5, wherein the shapes of the first resonator and the second resonator are determined such that when the coupling coefficient for the first resonator and the second resonator is set to be K and the Q factor at on load is set to be $Q_L$, the relationship of $K\,Q_L=1$ is approximately established.

7. A transmission channel coupler for an antenna according to claim 5, wherein:

the first resonator has an antenna connecting means in a part of its helical conductor, the connecting means being connected to the antenna;

the second resonator has a communication device connecting means in a part of its helical conductor to be connected to a communication device; and the loaded Q factor of the first resonator and the loaded Q factor of the second resonator are approximately equal.

8. A transmission channel coupler for an antenna according to claim 5, wherein the resonance frequency of the first resonator is approximately the same as the resonance frequency of the second resonator.

9. A transmission channel coupler for an antenna according to claim 5, wherein the inside diameter of the outer conductor of the first resonator is approximately equal to the inside diameter of the second resonator.

10. A transmission channel coupler for an antenna according to claim 5, wherein the ratio of the inside diameter of the outer conductor in the first resonator or the second resonator to the outside diameter of the helical conductor of the first resonator or the second resonator is 1.2–2.0 when the outer conductor is cylindrical in shape.

11. A transmission chnnel coupler for an antenna according to claim 5, wherein the coiling direction of the helical conductor of the first resonator is the same as the coiling direction of the helical conductor of the second resonator.

12. A transmission channel coupler for an antenna according to claim 5, wherein the insulating material is a glass window of a car.

13. A transmission channel coupler for an antenna according to claim 5, wherein the resonator fixing means tightly contacts the first or second resonator between the insulating material.

14. A transmission channel coupler for an antenna according to claim 5, wherein the resonator fixing means interposes an adhesion tape or a protective insulator between the first or second resonator and the insulating material.

15. A transmission channel coupler for an antenna according to claim 5, wherein the insulating material is a glass window of a building.

* * * * *